US010451324B2

(12) United States Patent
Kawagoe et al.

(10) Patent No.: US 10,451,324 B2
(45) Date of Patent: Oct. 22, 2019

(54) AIR-CONDITIONING APPARATUS

(71) Applicant: Mitsubishi Electric Corporation, Tokyo (JP)

(72) Inventors: Tomokazu Kawagoe, Tokyo (JP); Koji Azuma, Tokyo (JP); Kosuke Tanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 417 days.

(21) Appl. No.: 15/312,254

(22) PCT Filed: May 30, 2014

(86) PCT No.: PCT/JP2014/064527
§ 371 (c)(1),
(2) Date: Nov. 18, 2016

(87) PCT Pub. No.: WO2015/181980
PCT Pub. Date: Dec. 3, 2015

(65) Prior Publication Data

US 2017/0082334 A1 Mar. 23, 2017

(51) Int. Cl.
*F25B 45/00* (2006.01)
*F25B 1/00* (2006.01)
(Continued)

(52) U.S. Cl.
CPC ..... *F25B 45/00* (2013.01); *F24F 11/89* (2018.01); *F25B 1/00* (2013.01); *F25B 5/02* (2013.01);
(Continued)

(58) Field of Classification Search
CPC ..... F25B 45/00; F25B 49/02; F25B 13/00; F25B 1/00; F25B 5/02; F25B 2313/0315;
(Continued)

(56) References Cited

U.S. PATENT DOCUMENTS 2,268,048 A * 12/1941 McElgin ..... F24F 11/30 236/37
3,188,829 A * 6/1965 Siewert ..... F24F 5/00 62/160
(Continued)

FOREIGN PATENT DOCUMENTS

JP 2007-333269 A 12/2007
JP 2008-138923 A 6/2008
(Continued)

OTHER PUBLICATIONS

Extended EP Search Report dated Dec. 6, 2017 issued in corresponding EP patent application No. 14893682.6.
(Continued)

*Primary Examiner* — Claire E Rojohn, III
(74) *Attorney, Agent, or Firm* — Posz Law Group, PLC

(57) ABSTRACT

An air-conditioning apparatus includes two heat source units, each including a compressor, an outdoor heat exchanger functioning as an evaporator, an accumulator connected to a suction side of the compressor, and at least one of an outdoor air-sending device configured to supply air corresponding to a heat exchange target for refrigerant to the outdoor heat exchanger or a flow control device (bypass and expansion device for bypass) configured to regulate a flow rate of the refrigerant flowing through the outdoor heat exchanger. A controller is configured to control at least one of the outdoor air-sending device or the flow control device so that a suction quality of the compressor of an upper heat source unit installed on an upper side and a suction quality of the compressor of a lower heat source unit installed on a lower side become the same.

8 Claims, 5 Drawing Sheets

(51) Int. Cl.
*F25B 5/02* (2006.01)
*F25B 13/00* (2006.01)
*F25B 49/02* (2006.01)
*F24F 11/89* (2018.01)

(52) U.S. Cl.
CPC ..... *F25B 13/00* (2013.01); *F25B 49/02* (2013.01); *F25B 2313/0253* (2013.01); *F25B 2313/0313* (2013.01); *F25B 2313/0315* (2013.01); *F25B 2400/0409* (2013.01); *F25B 2500/19* (2013.01); *F25B 2600/2501* (2013.01); *F25B 2600/2513* (2013.01); *F25B 2700/1931* (2013.01); *F25B 2700/21152* (2013.01)

(58) Field of Classification Search
CPC ..... F25B 2400/0409; F25B 2500/19; F25B 2600/2501; F25B 2600/2513; F25B 2700/1931; F25B 2313/0253; F25B 2313/0313; F25B 2700/21152; F24F 11/89
USPC ..... 62/196.4
See application file for complete search history.

(56) References Cited

U.S. PATENT DOCUMENTS 3,195,622 A * 7/1965 Greene, Jr. ..... F24F 3/08 165/101
3,308,877 A * 3/1967 Gerteis ..... F24F 3/001 165/240
3,378,062 A * 4/1968 Ringquist ..... F24F 3/08 165/221
4,012,920 A * 3/1977 Kirschbaum ..... F24F 5/00 62/235.1
4,018,581 A * 4/1977 Ruff ..... F03G 6/00 237/2 B
4,067,383 A * 1/1978 Padden ..... F24D 3/02 165/101
4,098,092 A * 7/1978 Singh ..... F24D 11/0257 62/238.6
4,100,755 A * 7/1978 Leonard ..... F25B 15/06 62/104
4,111,259 A * 9/1978 Lebduska ..... F24D 11/0221 237/1 R
4,165,037 A * 8/1979 McCarson ..... F24F 3/001 237/1 R
4,179,894 A * 12/1979 Hughes ..... F24D 11/0221 62/79
4,187,687 A * 2/1980 Savage ..... F24D 11/0221 237/2 B
4,228,846 A * 10/1980 Smorol ..... F24D 5/12 165/240
4,256,475 A * 3/1981 Schafer ..... F24D 11/0221 62/235.1
4,257,238 A * 3/1981 Kountz ..... F24F 11/0009 62/176.3
4,313,307 A * 2/1982 Sisk ..... F25B 30/02 62/238.6
4,336,692 A * 6/1982 Ecker ..... F24D 11/0221 62/82
4,353,409 A * 10/1982 Saunders ..... F25B 13/00 165/240
4,441,331 A * 4/1984 Yuyama ..... F25B 13/00 62/196.3
4,441,901 A * 4/1984 Endoh ..... F24F 5/001 165/240
4,516,408 A * 5/1985 Chiba ..... F24D 5/12 62/238.7
4,614,090 A * 9/1986 Kaneko ..... F25B 13/00 62/158
4,644,756 A * 2/1987 Sugimoto ..... F24F 3/065 62/160
4,645,908 A * 2/1987 Jones ..... F24D 11/0214 392/340
4,693,089 A * 9/1987 Bourne ..... F24D 3/08 62/79
4,787,444 A * 11/1988 Countryman ..... F24D 11/0214 165/48.2
4,869,074 A * 9/1989 Hoshi ..... F24F 3/06 62/238.7
4,876,856 A * 10/1989 Iishiki ..... F01D 15/005 60/671
4,878,357 A * 11/1989 Sekigami ..... F24F 3/065 62/160
4,987,747 A * 1/1991 Nakamura ..... F24F 3/065 62/160
4,993,231 A * 2/1991 Torrence ..... B60H 1/3211 62/115
5,029,449 A * 7/1991 Wilkinson ..... F24F 1/0003 165/242
5,063,752 A * 11/1991 Nakamura ..... F24F 3/065 62/160
5,107,684 A * 4/1992 Nakayama ..... F24F 3/065 62/160
5,142,879 A * 9/1992 Nakamura ..... F24F 3/065 62/160
5,156,014 A * 10/1992 Nakamura ..... F24F 3/065 62/160
5,159,817 A * 11/1992 Hojo ..... F24F 3/065 62/199
5,161,388 A * 11/1992 Fujita ..... F24F 3/065 62/175
5,163,503 A * 11/1992 Inoue ..... F24F 3/065 165/231
5,181,392 A * 1/1993 Itoh ..... F24F 3/153 165/240
5,237,833 A * 8/1993 Hayashida ..... F24F 3/065 62/228.1
5,239,838 A * 8/1993 Tressler ..... F24D 11/0221 62/324.1
5,263,333 A * 11/1993 Kubo ..... F24F 3/065 62/160
5,272,885 A * 12/1993 Watanabe ..... F24F 3/06 62/184
5,277,034 A * 1/1994 Hojo ..... F24F 3/065 165/228
5,279,131 A * 1/1994 Urushihata ..... F24F 3/065 62/117
5,289,692 A * 3/1994 Campbell ..... B60H 1/3225 62/181
5,297,392 A * 3/1994 Takata ..... F24F 3/065 236/49.3
5,309,728 A * 5/1994 Chae ..... F24F 3/065 62/158
5,320,166 A * 6/1994 Swenson ..... F24F 3/06 165/236
5,370,307 A * 12/1994 Uehra ..... F24F 3/001 237/2 B
5,381,671 A * 1/1995 Saito ..... F24F 3/065 62/430
5,461,876 A * 10/1995 Dressler ..... F25B 5/02 62/160
5,526,649 A * 6/1996 Sada ..... F24F 1/26 62/175
5,628,200 A * 5/1997 Pendergrass ..... F24F 3/06 62/197
5,664,421 A * 9/1997 Matsue ..... F24F 3/06 62/6
5,689,962 A * 11/1997 Rafalovich ..... F24F 3/153 62/324.1
5,720,179 A * 2/1998 Jung ..... F24F 3/065 62/160
5,761,921 A * 6/1998 Hori ..... F25B 11/00 62/238.4
5,848,537 A * 12/1998 Biancardi ..... F04C 29/0007 62/324.6

(56) References Cited

U.S. PATENT DOCUMENTS 5,878,810 A * 3/1999 Saito ..... F25B 1/02 165/240
6,006,528 A * 12/1999 Arima ..... F25B 25/005 165/104.25
6,126,080 A * 10/2000 Wada ..... F24F 11/30 236/51
6,170,270 B1 * 1/2001 Arshansky ..... F25D 17/02 62/185
6,244,057 B1 * 6/2001 Yoshida ..... F25B 13/00 62/160
6,467,289 B2 * 10/2002 Kuroki ..... F24D 19/1054 62/201
6,637,216 B1 * 10/2003 Narney, II ..... F04C 23/008 417/357
6,883,345 B2 * 4/2005 Lee ..... F25B 13/00 62/324.6
7,308,800 B2 * 12/2007 Park ..... F25B 13/00 62/159
7,451,611 B2 * 11/2008 Muscatell ..... F24F 5/0046 62/235.1
8,001,802 B2 * 8/2011 Choi ..... F25B 7/00 62/332
8,047,011 B2 * 11/2011 Kawano ..... F25B 13/00 62/160
8,109,111 B2 * 2/2012 Yamada ..... F25B 13/00 62/324.1
8,220,280 B2 * 7/2012 Chang ..... F25B 49/005 62/149
8,261,569 B2 * 9/2012 Choi ..... F25B 13/00 62/324.6
8,281,614 B2 * 10/2012 Koo ..... F01C 21/02 62/506
8,752,397 B2 * 6/2014 Yamashita ..... F24F 3/06 62/151
9,638,430 B2 * 5/2017 Motomura ..... F25B 13/00
9,671,144 B1 * 6/2017 El-Shaarawi ..... F25B 41/043
9,816,736 B2 * 11/2017 Yamashita ..... F25B 13/00
9,909,784 B2 * 3/2018 Toya ..... F25B 5/04
10,041,706 B2 * 8/2018 Shin ..... F25B 13/00
10,054,348 B2 * 8/2018 Shin ..... F25B 49/02
2003/0014988 A1 * 1/2003 Watanabe ..... F25B 41/04 62/201
2003/0041609 A1 * 3/2003 Kasagi ..... F01N 5/02 62/238.7
2003/0070445 A1 * 4/2003 Kasagi ..... F25B 13/00 62/238.7
2003/0230107 A1 * 12/2003 Lee ..... F25B 13/00 62/324.6
2004/0074254 A1 * 4/2004 Hiwata ..... F25B 9/008 62/402
2004/0141859 A1 * 7/2004 Narney, II ..... F04C 23/008 417/410.3
2005/0103033 A1 * 5/2005 Schwartz ..... F04B 49/20 62/185
2005/0193749 A1 * 9/2005 Hwang ..... F25B 13/00 62/160
2006/0037346 A1 * 2/2006 Cho ..... F25B 13/00 62/323.1
2006/0037352 A1 * 2/2006 Cho ..... F25B 13/00 62/323.3
2006/0070719 A1 * 4/2006 Kim ..... F24F 1/26 165/61
2006/0096306 A1 * 5/2006 Okaza ..... F25B 9/06 62/228.1
2006/0162353 A1 * 7/2006 Ha ..... F25B 13/00 62/149
2006/0179868 A1 * 8/2006 Yoon ..... F25B 13/00 62/324.6
2006/0196168 A1 * 9/2006 Seitz ..... B60T 17/02 60/278
2006/0254294 A1 * 11/2006 Shimamoto ..... F24F 3/065 62/238.7
2007/0012058 A1 * 1/2007 Cho ..... F25B 13/00 62/238.7
2007/0095087 A1 * 5/2007 Wilson ..... F25B 40/00 62/259.2
2007/0130978 A1 * 6/2007 Honda ..... F25B 13/00 62/238.7
2007/0180844 A1 * 8/2007 Fujiyoshi ..... F24F 3/065 62/271
2007/0196227 A1 * 8/2007 Okamoto ..... F01C 13/04 418/60
2007/0246117 A1 * 10/2007 Naganawa ..... B21C 37/151 138/108
2008/0060365 A1 * 3/2008 Sakitani ..... F25B 9/008 62/114
2008/0271881 A1 * 11/2008 Blecker ..... F24F 3/06 165/254
2009/0165480 A1 * 7/2009 Sakitani ..... F25B 31/004 62/192
2009/0255284 A1 * 10/2009 Yoshimi ..... F24F 3/065 62/149
2010/0051229 A1 * 3/2010 Choi ..... F25B 13/00 165/64
2010/0146998 A1 * 6/2010 Tomioka ..... F25B 13/00 62/228.3
2010/0170295 A1 * 7/2010 Okazaki ..... F04C 18/0215 62/510
2010/0199695 A1 * 8/2010 Shinozaki ..... F24F 1/26 62/238.7
2011/0023533 A1 * 2/2011 Shimazu ..... F25B 1/10 62/498
2011/0048053 A1 * 3/2011 Sekine ..... F25B 13/00 62/324.6
2011/0048054 A1 * 3/2011 Sekine ..... F25B 13/00 62/324.6
2012/0042674 A1 * 2/2012 Takenaka ..... F24F 3/06 62/180
2012/0118005 A1 * 5/2012 Yamashita ..... F24F 3/06 62/513
2012/0174610 A1 * 7/2012 Takayama ..... F25B 1/10 62/196.1
2013/0019622 A1 * 1/2013 Nakashima ..... F25B 13/00 62/160
2013/0081417 A1 * 4/2013 Tamura ..... F25B 13/00 62/160
2013/0145785 A1 * 6/2013 Nobuhiro ..... F25B 49/02 62/160
2013/0145786 A1 * 6/2013 Tamaki ..... F25B 13/00 62/161
2013/0167559 A1 * 7/2013 Kim ..... F25B 49/02 62/56
2013/0180274 A1 * 7/2013 Tamaki ..... F25B 13/00 62/115
2013/0192284 A1 * 8/2013 Kawai ..... F25D 21/06 62/156
2013/0227978 A1 * 9/2013 Kawai ..... F25B 49/02 62/160
2013/0247607 A1 * 9/2013 Love ..... F25B 31/002 62/470
2014/0157811 A1 * 6/2014 Shimazu ..... F25B 1/10 62/238.6
2014/0284024 A1 * 9/2014 Shin ..... F25B 29/003 165/63
2014/0331712 A1 * 11/2014 Kan ..... F25B 43/02 62/470
2015/0068241 A1 * 3/2015 Sun ..... F25B 41/04 62/324.6
2015/0075196 A1 * 3/2015 Yanachi ..... F25B 13/00 62/160
2015/0198341 A1 * 7/2015 Yokozeki ..... F25B 49/02 165/219
2015/0247661 A1 * 9/2015 Ishimura ..... F25B 13/00 62/225
2015/0267925 A1 * 9/2015 Inada ..... F25B 13/00 62/509
2015/0292756 A1 * 10/2015 Takenaka ..... F25B 13/00 62/160

(56) References Cited

U.S. PATENT DOCUMENTS

| | | | | |
|---|---|---|---|---|
| 2015/0300714 | A1* | 10/2015 | Ishimura | F25B 13/00 62/225 |
| 2016/0169572 | A1* | 6/2016 | Noboa | F25B 49/005 62/115 |
| 2016/0201951 | A1* | 7/2016 | Jeong | F25B 13/00 62/115 |
| 2016/0201952 | A1* | 7/2016 | Jeong | F25B 13/00 62/115 |
| 2016/0245536 | A1* | 8/2016 | Iwasaki | F25B 49/02 |
| 2016/0325612 | A1* | 11/2016 | Chatroux | B60K 6/24 |
| 2016/0377333 | A1* | 12/2016 | Bertagnolio | G05B 13/048 62/56 |
| 2017/0167767 | A1* | 6/2017 | Shi | F25B 1/00 |
| 2017/0234582 | A1* | 8/2017 | Hatomura | F24F 11/89 62/160 |
| 2017/0336116 | A1* | 11/2017 | Fukui | F25B 41/04 |

FOREIGN PATENT DOCUMENTS

| | | | |
|---|---|---|---|
| JP | 2009-138973 | A | 6/2009 |
| JP | 2011-202884 | A | 10/2011 |
| WO | 2009/040889 | A1 | 4/2009 |
| WO | 2014/054154 | A1 | 4/2014 |

OTHER PUBLICATIONS

International Search Report of the International Searching Authority dated Sep. 2, 2014 for the corresponding international application No. PCT/JP2014/064527 (and English translation).

* cited by examiner

AIR-CONDITIONING APPARATUS

CROSS REFERENCE TO RELATED APPLICATION

This application is a U.S. national stage application of PCT/JP2014/064527 filed on May 30, 2014, the contents of which are incorporated herein by reference.

TECHNICAL FIELD

The present invention relates to an air-conditioning apparatus including a heat pump cycle mounted therein, which is configured to condition air in a space to be air-conditioned (bear an air conditioning load).

BACKGROUND ART

Hitherto, there has been proposed an air-conditioning apparatus including a heat pump cycle mounted therein, which is configured to condition air in a space to be air-conditioned (bear an air conditioning load). As the related-art air-conditioning apparatus described above, there has also been proposed an air-conditioning apparatus including a plurality of heat source units connected in parallel so as to construct a system capable of achieving a large capacity (see, for example, Patent Literature 1).

CITATION LIST

Patent Literature

Patent Literature 1: International Patent WO2009/040889A1 (FIG. 1 etc.)

SUMMARY OF INVENTION

Technical Problem

The air-conditioning apparatus described in Patent Literature 1 is a cooling and heating simultaneous type air-conditioning apparatus including a plurality of indoor units, which is capable of selecting a cooling operation and a heating operation independently in each of the indoor units. The air-conditioning apparatus described in Patent Literature 1 constructs the system capable of achieving the large capacity by connecting the plurality of heat source units in parallel by a refrigerant pipe as described above.

The related-art air-conditioning apparatus including the plurality of heat source units described above is, most of the time, mounted so that the heat source units are arranged approximately in a row. Under an environment where an installation space for mounting is not wide, however, the heat source units are required to be installed vertically in some situations (which, are more likely to occur with water-cooled heat source units, in particular).

On the other hand, there is a difference in installation height, which is allowable between the heat source units, as a product installation restriction. The balance of the amounts of refrigerant returning to each of the heat source units is disrupted due to a liquid head generated by a difference in height between the heat source units, and hence the allowable height difference is set as a height difference that does not adversely affect an operation.

In this case, when "allowable height difference between heat source units>height difference required for vertical installation of heat source units" is satisfied, the air-conditioning apparatus can be used without any problem. However, when "allowable height difference between heat source units<height difference required for vertical installation of heat source units" is satisfied, there is a problem in that the balance of the amounts of refrigerant returning to each of the heat source units is disrupted and adversely affects the operation of the air-conditioning apparatus.

In the case of a double-pipe cooling and heating simultaneous type air-conditioning apparatus, the system includes a return pipe (low-pressure pipe) configured to return refrigerant to the heat source unit with a larger diameter than a diameter of a supply pipe (high-pressure pipe) configured to cause the refrigerant to flow out of the heat source unit (diameters are small in cooling and heating switching air-conditioning apparatus). Thus, the amount of refrigerant present in the low-pressure pipe is large, and therefore there is a fear in that the double-pipe cooling and heating simultaneous type air-conditioning apparatus may be greatly affected by the above-mentioned liquid head. Further, even in the cooling and heating switching air-conditioning apparatus, the same applies when a diameter of a liquid main pipe is increased for lessening of a pressure loss as a product specification.

The present invention has been made to solve the problem described above, and has an object to provide an air-conditioning apparatus capable of suppressing imbalance between the amounts of refrigerant even when heat source units are installed in a vertical direction at different heights.

Solution to Problem

According to one embodiment of the present invention, there is provided an air-conditioning apparatus, including: at least one indoor unit including: an indoor heat exchanger; and an indoor-side expansion device; a plurality of heat source units connected in parallel to the at least one indoor unit, each of the plurality of heat source units including: a compressor; an outdoor heat exchanger configured to function at least as an evaporator; an accumulator connected to a suction side of the compressor; and at least one of a heat exchange target supply unit configured to supply a heat exchange target for refrigerant to the outdoor heat exchanger or a flow control device configured to regulate a flow rate of the refrigerant flowing through the outdoor heat exchanger; and a controller configured to control at least one of the heat exchange target supply unit or the flow control device, in which two of the plurality of heat source units include one unit corresponding to an upper heat source unit installed on an upper side and an other unit corresponding to a lower heat source unit installed below the upper heat source unit, and in which the controller is configured to, under a state in which the outdoor heat exchanger functions as an evaporator, control at least one of the heat exchange target supply unit or the flow control device so that a suction equality of the compressor of the upper heat source unit and a suction quality of the compressor of the lower heat source unit become the same.

Advantageous Effects of Invention

According to the air-conditioning apparatus of one embodiment of the present invention, even when the two heat source units are installed in the vertical direction at the different heights, the occurrence of imbalance in the amount of refrigerant between both the heat source units can be suppressed.

DESCRIPTION OF EMBODIMENTS

Figure 1:
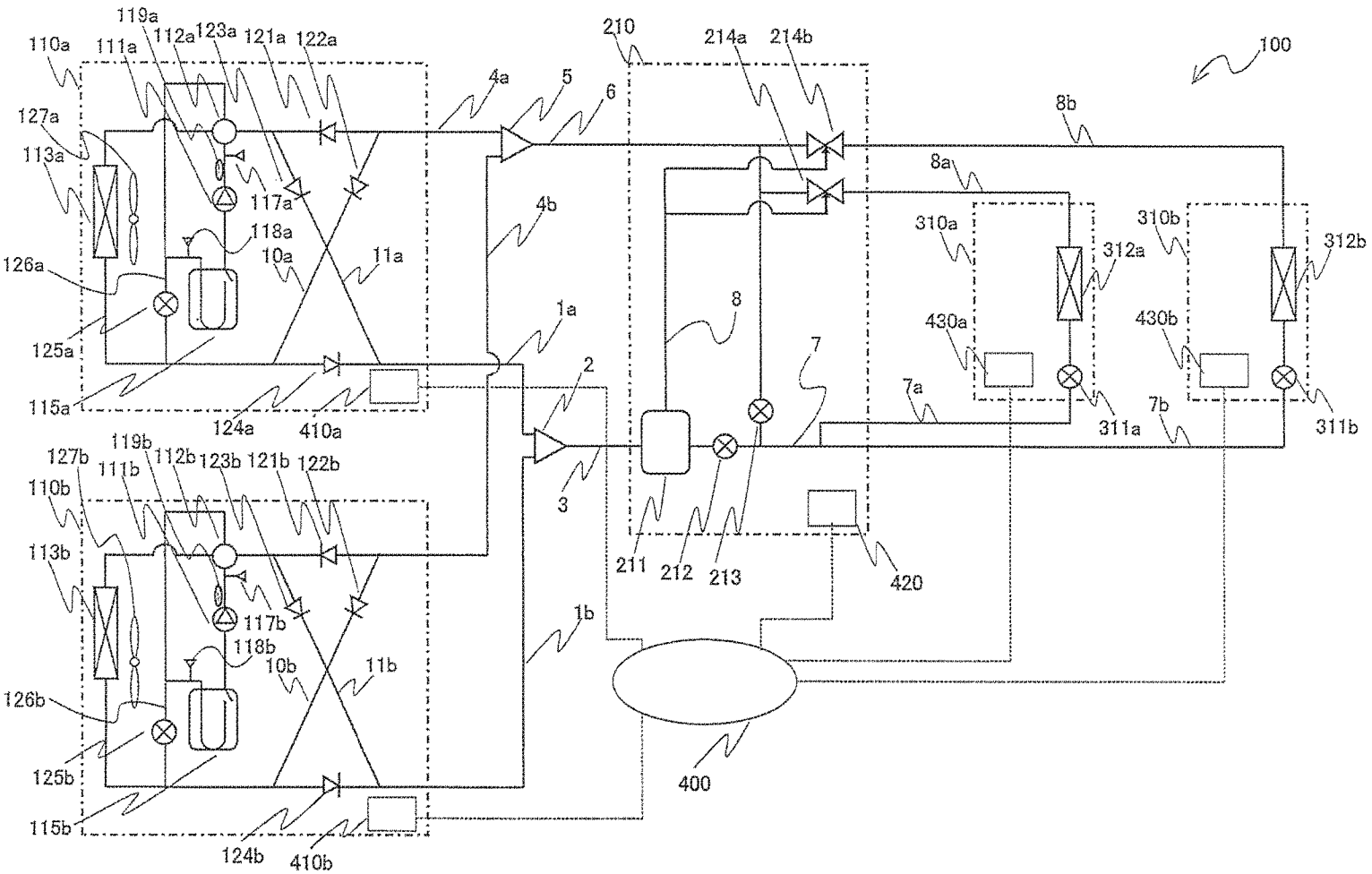
FIG. 1 is a circuit diagram for schematically illustrating a refrigerant circuit configuration of an air-conditioning apparatus according to an embodiment of the present invention.

An embodiment of the present invention is now described referring to the drawings.

FIG. 1 is a circuit diagram for schematically illustrating a refrigerant circuit configuration of an air-conditioning apparatus according to the embodiment of the present invention. Referring to FIG. 1, a configuration of the air-conditioning apparatus 100 is described. In the figures referring to below, including FIG. 1, a dimensional relationship between components may sometimes differ from an actual one.

The air-conditioning apparatus 100 is to be installed in a building, an apartment, a hotel, or other places, and uses a refrigeration cycle (heat pump) configured to circulate refrigerant therethrough so as to be capable of simultaneously bearing a cooling load and a heating load. Heat source units 110, a branch unit 210, and indoor units 310 are connected to construct the air-conditioning apparatus 100. Among the above-mentioned units, the indoor units 310 are connected in parallel to the heat source units 110 through the branch unit 210. For the two heat source units 110, the indices "a" and "b" are used so as to distinguish the heat source unit 110 installed on an upper side and the heat source unit 110 installed on a lower side. Items without the indices "a" and "b" are items (common items) that can be described for both the heat source unit 110*a* and the heat source unit 110*b*.

Two refrigerant pipes (high-pressure main pipe 1, low-pressure main pipe 4) are connected to the heat source unit 110. Further, a high-pressure main pipe 1*a* and a high-pressure main pipe 1*b* are connected to a high-pressure main pipe 3 via a high-pressure distributor 2. A low-pressure main pipe 4*a* and a low-pressure main pipe 4*b* are connected to a low-pressure main pipe 6 via a low-pressure distributor 5. Two refrigerant pipes (high-pressure main pipe 3, low-pressure main pipe 6) connected to a gas-liquid separator are connected to the branch unit 210. The branch unit 210 and the indoor unit 310 are connected by two refrigerant pipes (liquid refrigerant pipe 7, gas refrigerant pipe 8). The heat source units 110 are brought into communication to the indoor units 310 via the branch unit 210.

In FIG. 1, a case where the two indoor units 310 are connected is illustrated as an example. In order to distinguish the two indoor units from each other, the reference symbol is followed by the index "a" or "b". Further, components corresponding to the indoor unit 310*a* are denoted by the reference symbols followed by the index "a", whereas components corresponding to the indoor unit 310*b* are denoted by the reference symbols followed by the index "b".

The liquid refrigerant pipe 7 is branched into as many liquid refrigerant pipes 7 (into two in this case) as the number of indoor units 310 connected to the branch unit 210. The branched liquid refrigerant pipes 7 are referred to as a liquid branch pipe 7*a* and a liquid branch pipe 7*b*. Similarly, the gas refrigerant pipe 8 is branched into as many gas refrigerant pipes 8 (into two in this case) as the number of indoor units 310 connected to the branch unit 210. The branched gas refrigerant pipes 8 are referred to as a gas branch pipe 8*a* and a gas branch pipe 8*b*. The liquid branch pipe 7*a* and the gas branch pipe 8*a* are connected to the indoor unit 310*a*, whereas the liquid branch pipe 7*b* and the gas branch pipe 8*b* are connected to the indoor unit 310*b*.

[Heat Source Unit 110]

The heat source unit 110 has a function of supplying heating energy or cooling energy to the indoor unit 310 through the branch unit 210. The heat source unit 110 mainly includes a compressor 111, a flow switching valve 112, an outdoor heat exchanger 113, check valves 121 to 124, and an accumulator (liquid storage container) 115. A circuit illustrated in FIG. 1 is constructed by sequentially connecting the above-mentioned components in series. Refrigerant circuit components to be used inside the heat source unit only need to be selected and the refrigerant circuit only needs to be constructed depending on a purpose of use of the heat source unit 110.

Further, the heat source unit 110 includes a bypass 126 and an expansion device for bypass 125, which are configured to regulate a flow rate of the refrigerant flowing through the outdoor heat exchanger 113 while the outdoor heat exchanger 113 is functioning as an evaporator. The bypass 126 is a refrigerant pipe connected to a refrigerant inflow side and a refrigerant outflow side of the outdoor heat exchanger 113. The expansion device for bypass 125 is included in the bypass 126, and is configured to regulate the flow rate of the refrigerant flowing through the bypass 126. The expansion device for bypass 125 is preferred to be constructed of an expansion device capable of variably controlling an opening degree, for example, a precise flow control unit using an electronic expansion valve. In this case, the bypass 126 and the expansion device for bypass 125 correspond to a flow control unit of the present invention.

As long as the compressor 111 can suck the refrigerant and compress the sucked refrigerant into a high-temperature and high-pressure state, the type thereof is not particularly limited. For example, compressors of various types such as a reciprocating, rotary, scroll, and screw types may be used to construct the compressor 111. The compressor 111 is preferred to be constructed of a compressor of a type capable of variably controlling the rotation speed by an inverter.

The flow switching valve 112 is constructed of, for example, a four-way valve, and is configured to switch a flow of the refrigerant in accordance with a required operation mode. The outdoor heat exchanger 113 has a role of rejecting heat or taking away heat mainly from a heat exchange target (for example, air, water, or brine) for the refrigerant. The kind of outdoor heat exchanger 113 only needs to be selected in accordance with the heat exchange target to be used, and may be constructed of an air heat exchanger when air is the heat exchange target and may be constructed of a water heat exchanger when water or brine is the heat exchange target. As exemplified in FIG. 1, when the outdoor heat exchanger 113 is the air heat exchanger, it is preferred that an outdoor air-sending device 127 (heat exchange target supply unit) configured to supply air being the heat exchange target to the outdoor heat exchanger be provided. The accumulator 115 only needs to accumulate surplus refrigerant therein.

Further, the heat source unit 110 includes the four check valves 121 to 124. The check valve 121 is provided to the low-pressure main pipe 4 between the flow switching valve 112 and the branch unit 210 so as to allow the flow of the refrigerant to flow only in a direction from the branch unit 210 to the heat source unit 110*a* and the heat source unit 110*b*. The check valve 124 is provided to the high-pressure main pipe 1 between the outdoor heat exchanger 113 and the branch unit 210 so as to allow the flow of the refrigerant to flow only in a direction from the heat source unit 110*a* and the heat source unit 110*b* to the branch unit 210.

The high-pressure main pipe 1 and the low-pressure main pipe 4 are connected by a first connecting pipe 10 configured to connect an upstream side of the check valve 124 and an upstream side of the check valve 121 and a second connecting pipe 11 configured to connect a downstream side of the check valve 124 and a downstream side of the check valve 121. The check valve 122 configured to allow the flow of the refrigerant to flow only in a direction from the low-pressure main pipe 4 to the high-pressure main pipe 1 is provided to the first connecting pipe 10. A check valve 123 configured to allow the flow of the refrigerant to flow only in a direction from the low-pressure main pipe 4 to the high-pressure main pipe 1 is provided to the second connecting pipe 11.

The first connecting pipe 10, the second connecting pipe 11, the check valve 121, the check valve 122, the check valve 123, and the check valve 124 are thus provided thereby the flow of the refrigerant into the branch unit 210 can be directed to a constant direction regardless of the required operation for the indoor unit 310. However, those components are not essential.

Further, the heat source unit 110 includes a high pressure sensor 117, a low pressure sensor 118, and a discharge temperature sensor 119, and other components. The high pressure sensor 117 is configured to detect a pressure of the refrigerant discharged from the compressor 111, and corresponds to a first pressure detecting unit of the present invention. The low pressure sensor 118 is configured to detect the pressure of the refrigerant flowing through the outdoor heat exchanger 113 when the outdoor heat exchanger 113 functions as an evaporator, and corresponds to a second pressure detecting unit of the present invention. The discharge temperature sensor 119 is configured to detect a temperature of the refrigerant discharged from the compressor 111, and corresponds to a discharged refrigerant temperature detecting unit of the present invention.

[Branch Unit 210]

The branch unit 210 has a function of supplying the refrigerant (heating energy or cooling energy) supplied from the heat source unit 110 to the indoor unit 310. The branch unit 210 mainly includes a gas-liquid separator 211, flow switching valves 214, an expansion device 212, and an expansion device 213. The flow switching valves 214 are provided in number (two in this case) corresponding to the number of indoor units 310 connected to the branch unit 210.

The flow switching valves 214 are configured to switch the flow of the refrigerant to be supplied to the indoor unit 310. The refrigerant flow is switched by the flow switching valves 214 so that the indoor units 310 connected to the branch unit 210 can simultaneously execute cooling and heating. Each of the flow switching valves 214 is constructed of, for example, a three-way valve so that one way is connected to the low-pressure main pipe 6, a further way is connected to the gas-liquid separator 211, and a still further way is connected to the indoor heat exchanger 312 of the indoor unit 310.

The gas-liquid separator 211 is connected to the high-pressure main pipe 3 and is connected to each of an inflow side and an outflow side of the indoor unit 310. The gas-liquid separator 211 has a function of separating the inflow refrigerant into gas refrigerant and liquid refrigerant. The gas-liquid separator 211 is mounted when the refrigerant pipe between the heat source unit 110 and the branch unit 210 is of a double-pipe type. In FIG. 1, the air-conditioning apparatus including the plurality of indoor units 310 connected to one branch unit 210 is illustrated as an example. When the refrigerant pipe between the heat source unit 110 and the branch unit 210 is of, for example, a three pipe type, however, one branch unit 210 may be connected to one indoor unit 310.

The expansion device 212 is provided between the gas-liquid separator 211 and an indoor-side expansion device 311, and is configured to reduce a pressure of the refrigerant to expand the refrigerant. The expansion device 213 is provided to a connecting pipe configured to connect the low-pressure main pipe 6 and a pipe between the expansion device 212 and the indoor-side expansion device 311, and is configured to reduce the pressure of the refrigerant to expand the refrigerant. Each of the expansion device 212 and the expansion device 213 is preferred to be constructed of an expansion device capable of variably controlling an opening degree, for example, a precise flow control unit using an electronic expansion valve or an inexpensive refrigerant flow control device, e.g., a capillary tube.

(Indoor Unit 310)

The indoor unit 310 has a function of receiving the supply of refrigerant (heating energy or cooling energy) from the heat source unit 110 to bear a heating load or a cooling load. The indoor unit 310 mainly includes the indoor-side expansion device 311 and the indoor heat exchanger 312 (load-side heat exchanger) that are connected in series. In FIG. 1, there is exemplified a state in which the two indoor units 310*a* and 310*b* are connected in parallel, but the number of the indoor units 310 is not particularly limited. Three or more indoor units 310 may be connected similarly. Further, the indoor unit 310 is preferred to include an indoor-side air-sending device, e.g., a fan (not shown), which is configured to supply air to the indoor heat exchanger 312, in the vicinity of the indoor heat exchanger 312.

The indoor-side expansion device 311 has a function as a pressure reducing valve and an expansion valve, and is configured to reduce a pressure of the refrigerant to expand the refrigerant. The indoor-side expansion device 311 is preferred to be constructed of an expansion device capable of variably controlling an opening degree, for example, a precise flow control device using an electronic expansion valve or an inexpensive refrigerant flow control device, e.g., a capillary tube. The indoor heat exchanger 312 functions as a radiator (condenser) during a heating operation and as an evaporator during a cooling operation, and is configured to exchange heat between air supplied from an indoor-side air-sending device (not shown) and the refrigerant so as to condense and liquefy or evaporate and gasify the refrigerant.

Although the air type indoor unit 310 is illustrated in FIG. 1, the indoor unit is not limited thereto. When the indoor unit 310 is a unit configured to cool and/or heat water, e.g., a chiller or a hot-water supply unit, the indoor unit 310 may be replaced by a water heat exchanger.

Further, the indoor unit 310 includes a temperature detector element (not shown). The temperature detector element is configured to detect a load at a location of installation, and is constructed of, for example, a thermistor. The location of installation and the kind of temperature detector element are not particularly limited. Hence, the location of installation and the kind only need to be selected in accordance with characteristics of the indoor unit 310 or a load desired to be detected.

As described above, the air-conditioning apparatus 100 has a system configuration in which the heat source units 110 are connected to the indoor units 310 through the branch unit 210.

The air-conditioning apparatus 100 includes a controller 400 configured to collectively control an overall system of the air-conditioning apparatus 100. The controller 400 is configured to control, for example, a drive frequency of the compressor 111, a rotation speed (amount of air) of the outdoor air-sending device 127, switching of the flow switching valve 112, an opening degree of each of the expansion devices, and switching of the flow switching valve 214. Specifically, the controller 400 is configured to control each of actuators (driving components for the compressor 111, the flow switching valve 112, the outdoor air-sending device 127, and each of the expansion devices) based on information detected by various detector elements (not shown) and an instruction from a remote controller. In the air-conditioning apparatus 100 illustrated in FIG. 1 and FIG. 5 referred to later, the controller 400 is separated from the heat source units 110 and is illustrated as a system controller. However, for example, the heat source unit 110*a* may include the controller 400 so as to communicate to/from control units 410*a*, 410*b*, 420, 430*a*, and 430*b* to perform the collective control. Further, the controller 400 is described in detail referring to FIG. 2.

[Other Target System Configurations]

Although a case where the air-conditioning apparatus 100 is of the double-pipe cooling and heating simultaneous type in which the heat source units 110 and the indoor units 310 are connected by the two refrigerant pipes through the branch unit 210 is taken as an example in FIG. 1, the air-conditioning apparatus is not limited thereto. The air-conditioning apparatus may be of a triple-pipe cooling and heating simultaneous type or cooling and heating switching type in which the units are connected by three refrigerant pipes.

Figure 2:
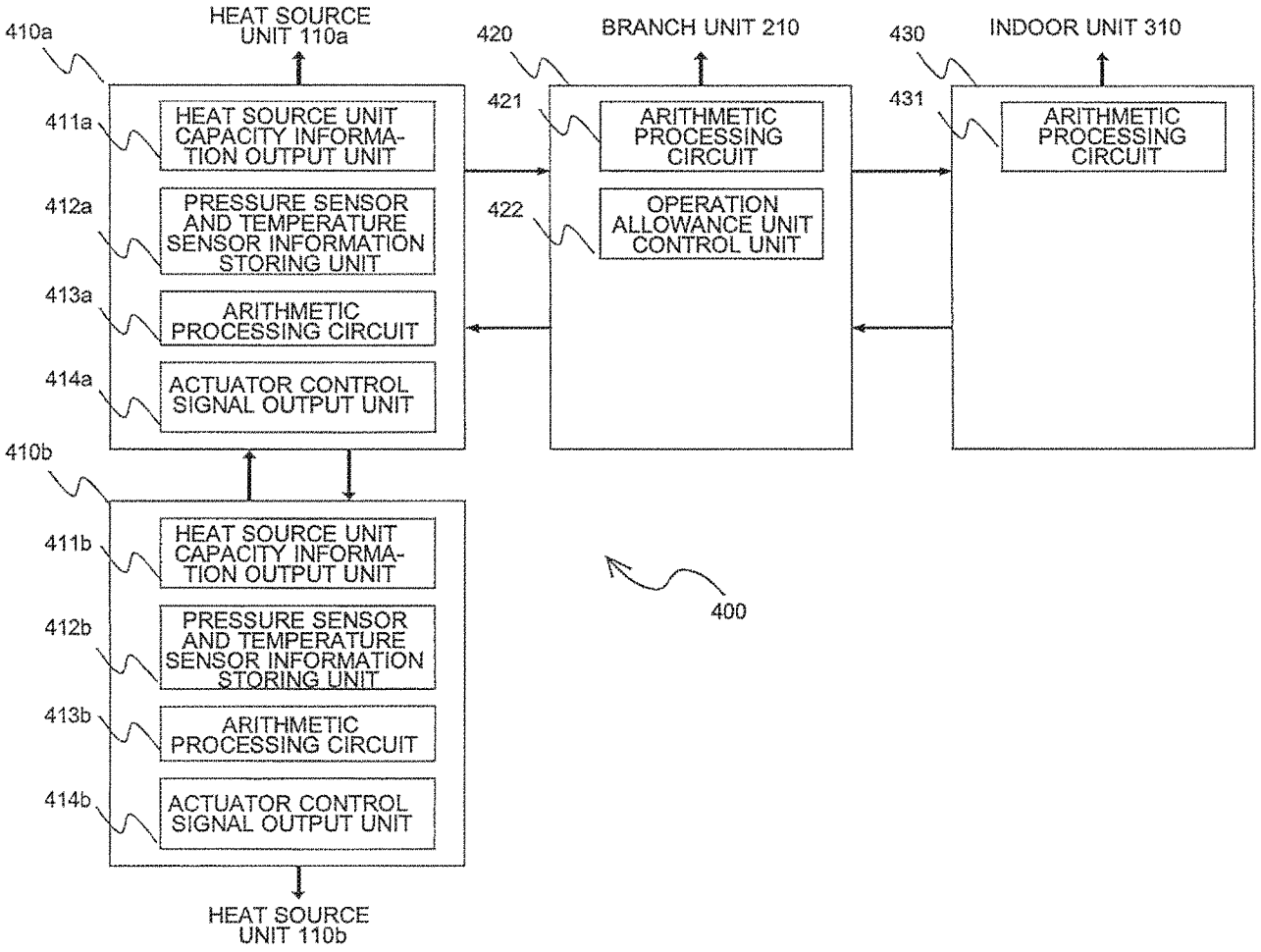
FIG. 2 is a control block diagram for illustrating an electrical configuration of the air-conditioning apparatus according to the embodiment of the present invention.

FIG. 2 is a control block diagram for illustrating an electrical configuration of the air-conditioning apparatus according to the embodiment of the present invention. Referring to FIG. 2, the controller 400 mounted in the air-conditioning apparatus 100 is described in detail.

As described above, the air-conditioning apparatus 100 includes the controller 400. The controller 400 is constructed of, for example, a microcomputer and of a DSP, and has a function of controlling the overall system of the air-conditioning apparatus 100. The controller 400 includes the heat source-unit control unit 410, the branch-unit control unit 420, and the indoor-unit control unit 430.

For allocation of the control units, distributed autonomous cooperative control for providing the corresponding control unit to each of the units so that each of the units performs control independently may be performed, or any one of the units may include all the control units so that the unit including the control units gives a control command to an other unit through communication or other measures. For example, when the heat source-unit control units 410 are provided to the heat source units 110, the branch-unit control unit 420 is provided to the branch unit 210, and the indoor-unit control units 430 are provided to the indoor units 310, each of the units can perform control independently. Each of the control units can transmit information through wireless or wired communication means.

The heat source-unit control unit 410 has a function of controlling a pressure state of the refrigerant and a temperature state of the refrigerant in the heat source unit 110. The heat source-unit control unit 410 includes a heat source unit capacity information output unit 411, a pressure sensor and temperature sensor information storing unit 412, an arithmetic processing circuit 413, and an actuator control signal output unit 414, and other components. More specifically, the heat-source unit control unit 410 has functions of storing information obtained by the high pressure sensor 117, the low pressure sensor 118, the discharge temperature sensor 119, and other sensors in the pressure sensor and temperature sensor information storing unit 412 as data and performing arithmetic processing in the arithmetic processing circuit 413 inside the heat-source unit 110 based on the stored information, and then outputting from the actuator control signal output unit 414 the drive frequency of the compressor 111, the rotation speed of the outdoor air-sending device 127, and the switching of the flow switching valve 112, and controlling the opening degree of the expansion device for bypass 125.

The heat source unit capacity information output unit 411 is configured to define a maximum value of the number of the indoor units 310 connectable to the branch unit 210 and a maximum value of the capacity in accordance with the capacity of the heat source unit 110, and has a function of transmitting this information to the branch unit 210.

The branch-unit control unit 420 has functions of, for example, operating the flow switching valve 214 of the branch unit 210 and controlling the opening degrees of the expansion device 212 and the expansion device 213 in the arithmetic processing circuit 421 based on information of a pressure sensor and a temperature sensor of the branch unit 210 itself. Further, the branch-unit control unit 420 also has a function of restricting a connecting capacity and an operating capacity of the indoor units 310 in an operation allowance unit determining unit 422 based on information of a connecting capacity and an operating capacity received from the heat source units 110.

The indoor-unit control unit 430 has a function of controlling a degree of superheat during the cooling operation of the indoor unit 310 and a degree of subcooling during the heating operation of the indoor unit 310. More specifically, the indoor-unit control unit 430 has functions of obtaining the degree of superheat during the cooling operation and the degree of subcooling during the heating operation in the arithmetic processing circuit 431 based on the information of the pressure sensor and the temperature sensor of the indoor unit 310 itself to change a heat exchange area of the indoor heat exchanger 312, control a fan rotation speed of the indoor-side air-sending device, and control the opening degree of the indoor-side expansion device 311 so that those degree of superheat and degree of subcooling become equal to a target degree of superheat and a target degree of subcooling.

Next, an operation of the air-conditioning apparatus 100 is described.

Operation modes executed by the air-conditioning apparatus 100 include a cooling operation mode in which all the operating indoor units 310 execute the cooling operation, a heating operation mode in which all the operating indoor units 310 execute the heating operation, a cooling main operation mode in which there are the indoor unit 310 performing the heating operation and the indoor unit 310 performing the cooling operation in a mixed manner with a larger cooling load, and a heating main operation mode in which there are the indoor unit 310 performing the heating operation and the indoor unit 310 performing the cooling operation in a mixed manner with a larger heating load.

[Cooling Operation Mode]

The refrigerant circuit in the cooling operation mode in which all the operating indoor units 310 are performing the cooling operation and contents of the operation are first described.

In the heat source unit 110, low-pressure gas refrigerant is sucked into the compressor 111 to turn into high-temperature and high-pressure gas refrigerant, which then passes through the flow switching valve 112 to flow into the outdoor heat exchanger 113 functioning as the radiator (condenser). The high-pressure gas refrigerant flowing into the outdoor heat exchanger 113 exchanges heat with air (or water) supplied to the outdoor heat exchanger 113 to be condensed into high-pressure liquid refrigerant, which then flows out of the outdoor heat exchanger 113. The high-pressure liquid refrigerant flowing out of the outdoor heat exchanger 113 passes through the check valve 124 to flow into the high-pressure main pipe 1.

The high-pressure liquid refrigerant flowing out of the heat source unit 110*a* to the high-pressure main pipe 1*a* and the high-pressure liquid refrigerant flowing out of the heat source unit 110*b* into the high-pressure main pipe 1*b* are joined to each other at the high-pressure distributor 2. After flowing to the high-pressure main pipe 3, the joined high-pressure liquid refrigerant flows into the branch unit 210.

In the branch unit 210, the high-pressure liquid refrigerant flowing from the high-pressure main pipe 3 passes through the gas-liquid separator 211 and the expansion device 212 to flow into the liquid refrigerant pipe 7 to flow out of the branch unit 210. The refrigerant flowing out of the branch unit 210 flows into the indoor unit 310. In the indoor unit 310, the refrigerant turns into low-pressure two-phase gas-liquid refrigerant or low-pressure liquid refrigerant in the indoor-side expansion device 311, which then flows into the indoor heat exchanger 312. The low-pressure two-phase refrigerant or the low-pressure liquid refrigerant flowing into the indoor heat exchanger 312 is evaporated in the indoor heat exchanger 312 into low-pressure gas refrigerant, which then flows out of the indoor heat exchanger 312.

The low-pressure gas refrigerant flowing out of the indoor heat exchanger 312 flows through the gas refrigerant pipe 8 to flow out of the indoor unit 310, and then flows into the branch unit 210. The low-pressure gas refrigerant flowing into the branch unit 210 passes through the flow switching valves 214 (flow switching valve 214*a*, flow switching valve 214*b*) to be joined to each other, and then flows into the low-pressure main pipe 6.

After flowing out of the branch unit 210, the low-pressure gas refrigerant flowing into the low-pressure main pipe 6 passes through the low-pressure distributor 5 to flow into the low-pressure main pipe 4*a* (heat source unit 110*a* side) and the low-pressure main pipe 4*b* (heat source unit 110*b*).

The low-pressure gas refrigerant flowing into the heat source unit 110 passes through the check valve 121, the flow switching valve 112, and the accumulator 115 to be sucked into the compressor 111 again. A circuit through which the refrigerant flows as described above is used as a main circuit during the cooling operation.

[Heating Operation Mode]

Next, the refrigerant circuit in the heating operation mode in which all the operating indoor units 310 are performing the heating operation and contents of the operation are next described.

In the heat source unit 110, low-pressure gas refrigerant is sucked into the compressor 111 to turn into high-temperature and high-pressure gas refrigerant, which then passes through the flow switching valve 112 and the check valve 123 to flow into the high-pressure main pipe 1.

The high-temperature and high-pressure gas refrigerant flowing out of the heat source unit 110*a* to the high-pressure main pipe 1*a* and the high-temperature and high-pressure gas refrigerant flowing out of the heat source unit 110*b* into the high-pressure main pipe 1*b* are joined to each other at the high-pressure distributor 2. After flowing to the high-pressure main pipe 3, the joined high-temperature and high-pressure gas refrigerant flows into the branch unit 210.

In the branch unit 210, the high-pressure gas refrigerant flowing from the high-pressure main pipe 3 passes through the gas-liquid separator 211 and the flow switching valves 214 (flow switching valve 214*a*, flow switching valve 214*b*) to flow into the gas refrigerant pipe 8. After flowing out of the branch unit 210, the refrigerant flowing through the gas refrigerant pipe 8 flows into the indoor unit 310.

The high-pressure gas refrigerant flowing into the indoor unit 310 flows into the indoor heat exchanger 312 to be condensed in the indoor heat exchanger 312 into high-pressure liquid refrigerant, which then flows out of the indoor heat exchanger 312. The high-pressure liquid refrigerant flowing out of the indoor heat exchanger 312 is turned into low-pressure two-phase gas-liquid refrigerant or low-pressure liquid refrigerant in the indoor-side expansion device 311, which then flows into the liquid refrigerant pipe 7. After flowing out of the indoor unit 310, the two-phase refrigerant or the low-pressure liquid refrigerant flows into the branch unit 210. After joined together in the branch unit 210, the low-pressure refrigerant flowing through the liquid refrigerant pipe 7 passes through the expansion device 213 to flow into the low-pressure main pipe 6.

After flowing out of the branch unit 210, the low-pressure two-phase refrigerant flowing into the low-pressure main pipe 6 passes through the low-pressure distributor 5 to flow into the low-pressure main pipe 4*a* (heat source unit 110*a* side) and the low-pressure main pipe 4*b* (heat source unit 110*b*).

After the low-pressure refrigerant flowing into the heat source unit 110 flows through the check valve 122 to turn into low-pressure gas refrigerant or two-phase refrigerant in the outdoor heat exchanger 113 functioning as an evaporator, the low-pressure refrigerant passes through the flow switching valve 112 and the accumulator 115 to be sucked into the compressor 111 again. A circuit through which the refrigerant flows as described above is used as a main circuit during the heating operation.

Now, operations during which the indoor units 310 include an indoor unit performing the cooling operation and an indoor unit performing the heating operation in a mixed manner are described. As the mixed operations, there are two kinds of operation modes, that is, a cooling main operation mode and a heating main operation mode. The operation mode is switched so that capability or efficiency becomes the highest by comparing a condensing temperature and an evaporating temperature of the refrigerant in the air-conditioning apparatus 100 with target values set in the heat source unit 110. Each of the operation modes is described below.

[Cooling Main Operation Mode]

Next, a refrigerant circuit when the indoor units 310 perform the cooling and heating mixed operation in the cooling main operation mode in which the cooling load is larger than the heating load, and contents of the operation are described. Here, the cooling main operation mode is described for a case where the indoor unit 310*a* performs the cooling operation and the indoor unit 310*b* performs the heating operation as an example.

In the heat source unit 110, the low-pressure gas refrigerant is sucked into the compressor 111 to turn into high-temperature and high-pressure gas refrigerant, which then passes through the flow switching valve 112 to flow into the outdoor heat exchanger 113 functioning as the radiator (condenser). The high-pressure gas refrigerant flowing into the outdoor heat exchanger 113 exchanges heat with the air supplied to the outdoor heat exchanger 113 to be condensed into high-pressure two-phase gas-liquid refrigerant, which then flows out of the outdoor heat exchanger 113. The high-pressure two-phase refrigerant flowing out of the outdoor heat exchanger 113 passes through the check valve 124 to flow into the high-pressure main pipe 1.

The high-pressure two-phase refrigerant flowing out of the heat source unit 110*a* into the high-pressure main pipe 1*a* and the high-pressure two-phase refrigerant flowing out of the heat source unit 110*b* into the high-pressure main pipe 1*b* are joined to each other in the high-pressure distributor 2. After flowing into the high-pressure main pipe 3, the joined two-phase refrigerant flows into the branch unit 210.

In the branch unit 210, the high-pressure two-phase refrigerant flowing from the high-pressure main pipe 3 is separated into a high-pressure saturated gas and a high-pressure saturated liquid in the gas-liquid separator 211. The high-pressure saturated gas (gas refrigerant) separated in the gas-liquid separator 211 passes through the flow switching valve 214*b* to flow to the gas branch pipe 8*b*. After flowing out of the branch unit 210, the high-pressure gas refrigerant flowing into the gas branch pipe 8*b* flows into the indoor unit 310*b*. The refrigerant flowing into the indoor unit 310*b* is condensed in the indoor heat exchanger 312*b* into high-pressure liquid refrigerant, which then flows out of the indoor heat exchanger 312*b*. The high-pressure liquid refrigerant flowing out of the indoor heat exchanger 312*b* turns into intermediate-pressure two-phase gas-liquid refrigerant or intermediate-pressure liquid refrigerant in the indoor-side expansion device 311*b*, which then flows into the liquid branch pipe 7*b*. After flowing out of the indoor unit 310*b*, the intermediate-pressure two-phase refrigerant or the intermediate-pressure liquid refrigerant is reused as refrigerant to be used during cooling.

On the other hand, the high-pressure saturated liquid (liquid refrigerant) separated in the gas-liquid separator 211 passes through the expansion device 212 to join the refrigerant flowing from the indoor unit 310*b*. The joined refrigerant flows to the liquid branch pipe 7*a* to flow out of the branch unit 210. The refrigerant flowing out of the branch unit 210 flows into the indoor unit 310*a*. In the indoor unit 310*a*, the refrigerant turns into low-pressure two-phase gas-liquid refrigerant or low-pressure liquid refrigerant in the indoor-unit expansion device 311*a*, which then flows into the indoor heat exchanger 312*a*. The low-pressure two-phase refrigerant or the low-pressure liquid refrigerant flowing into the indoor heat exchanger 312*a* is evaporated in the indoor heat exchanger 312*a* into low-pressure gas refrigerant, which then flows out of the indoor heat exchanger 312*a*.

The low-pressure gas refrigerant flowing out of the indoor heat exchanger 312*a* flows through the gas branch pipe 8*a* to flow out of the indoor unit 310*a*, and then flows into the branch unit 210.

Further, when the amount of liquid refrigerant accumulated in the liquid refrigerant pipe 7 increases, a pressure in the liquid refrigerant pipe 7 is increased to reduce a differential pressure from the indoor unit 310*b* that is currently performing the heating operation. As a result, the amount of circulation of refrigerant flowing in the indoor unit 310*b* is reduced to lower heating capacity. Therefore, the expansion device 213 is opened moderately to allow the liquid refrigerant accumulated in the liquid refrigerant pipe 7 to escape so as to cause the liquid refrigerant accumulated in the liquid refrigerant pipe 7 to flow to the low-pressure main pipe 6, thereby regulating the pressure in the liquid refrigerant pipe 7. Thus, the refrigerant flowing into the branch unit 210 turns into low-pressure two-phase refrigerant in the low-pressure main pipe 6 through mixture of the low-pressure gas refrigerant flowing from the indoor unit 310*a* to pass through the flow switching valve 214 (flow switching valve 214*a*) and the liquid refrigerant flowing from the expansion device 213.

After flowing out of the branch unit 210, the low-pressure two-phase refrigerant flowing into the low-pressure main pipe 6 passes through the low-pressure distributor 5 to flow into the low-pressure main pipe 4*a* (heat source unit 110*a* side) and the low-pressure main pipe 4*b* (heat source unit 110*b*).

The low-pressure two-phase refrigerant flowing to the low-pressure main pipe 4 flows into the heat source unit 110. The low-pressure two-phase refrigerant flowing into the heat source unit 110 passes through the check valve 121, the flow switching valve 112, and the accumulator 115 to be sucked into the compressor 111 again. A circuit through which the refrigerant flows as described above is used as a main circuit during the cooling main operation.

[Heating Main Operation Mode]

Next, a refrigerant circuit when the indoor units 310 perform the cooling and heating mixed operation and the indoor unit 310*b* performs the heating operation in the heating main operation mode in which the heating load is larger than the cooling load, and contents of the operation are described. Here, the heating main operation mode is described for a case where the indoor unit 310*a* performs the cooling operation and the indoor unit 310*b* performs the heating operation as an example.

In the heat source unit 110, low-pressure gas refrigerant is sucked into the compressor 111 to turn into high-temperature and high-pressure gas refrigerant, which then passes through the flow switching valve 112 and the check valve 123 to flow into the high-pressure main pipe 1.

The high-temperature and high-pressure gas refrigerant flowing out of the heat source unit 110*a* to the high-pressure main pipe 1*a* and the high-temperature and high-pressure gas refrigerant flowing out of the heat source unit 110*b* into the high-pressure main pipe 1*b* are joined to each other at the high-pressure distributor 2. After flowing to the high-pressure main pipe 3, the joined high-temperature and high-pressure gas refrigerant flows into the branch unit 210.

In the branch unit 210, the high-pressure gas refrigerant flowing from the high-pressure main pipe 3 passes through the gas-liquid separator 211 and the flow switching valves 214*b* to flow into the gas branch pipe 8*b*. After flowing out of the branch unit 210, the refrigerant flowing through the gas branch pipe 8*b* flows into the indoor unit 310*b*.

The high-pressure gas refrigerant flowing into the indoor unit 310*b* flows into the indoor heat exchanger 312*b* to be condensed in the indoor heat exchanger 312*b* into high-pressure liquid refrigerant, which then flows out of the indoor heat exchanger 312*b*. The high-pressure liquid refrigerant flowing out of the indoor heat exchanger 312*b* is turned into intermediate-pressure two-phase gas-liquid refrigerant or intermediate-pressure liquid refrigerant in the indoor-side expansion device 311*b*, which then flows into the liquid branch pipe 7*b*. After flowing out of the indoor unit 310*b*, the two-phase refrigerant or the intermediate-pressure liquid refrigerant flows into the branch unit 210.

The intermediate-pressure refrigerant flowing into the branch unit 210 flows to the liquid branch pipe 7*a*. After flowing out of the branch unit 210, the refrigerant flow into the indoor unit 310*a*. The refrigerant flowing into the indoor unit 310*a* turns into low-pressure two-phase gas-liquid refrigerant or low-pressure liquid refrigerant in the indoor-side expansion device 311*a*, which then flows into the indoor heat exchanger 312*a*. The low-pressure liquid refrigerant flowing into the indoor heat exchanger 312*b* is evaporated in the indoor heat exchanger 312*a* into low-pressure gas refrigerant, which then flows out of the indoor heat exchanger 312*a*.

When the amount of liquid refrigerant accumulated in the liquid refrigerant pipe 7 increases, a pressure in the liquid refrigerant pipe 7 is increased to reduce the differential pressure from the indoor unit 310*b* that is currently performing the heating operation. Hence, the amount of circulation of refrigerant flowing in the indoor unit 310*b* is reduced to lower the heating capacity. Therefore, the expansion device 213 is opened moderately to allow the liquid refrigerant accumulated in the liquid refrigerant pipe 7 to escape so as to cause the liquid refrigerant accumulated in the liquid refrigerant pipe 7 to flow to the low-pressure main pipe 6, thereby regulating the pressure in the liquid refrigerant pipe 7. Thus, the refrigerant flowing into the branch unit 210 turns into low-pressure two-phase refrigerant in the low-pressure main pipe 6 through mixture of the low-pressure gas refrigerant flowing from the indoor unit 310*b* to pass through the flow switching valve 214 (flow switching valve 214*a*) and the liquid refrigerant flowing from the expansion device 213.

After flowing out of the branch unit 210, the low-pressure two-phase refrigerant flowing into the low-pressure main pipe 6 passes through the low-pressure distributor 5 to flow into the low-pressure main pipe 4*a* (heat source unit 110*a* side) and the low-pressure main pipe 4*b* (heat source unit 110*b*).

After the low-pressure refrigerant flowing into the heat source unit 110 turns into low-pressure gas refrigerant or two-phase refrigerant in the outdoor heat exchanger 113 functioning as an evaporator, the low-pressure refrigerant or the two-phase refrigerant passes through the flow switching valve 112 and the accumulator 115 to be sucked into the compressor 111 again. A circuit through which the refrigerant flows as described above is used as a main circuit during the operation main operation.

[Target of Refrigerant Control]

Figure 3:
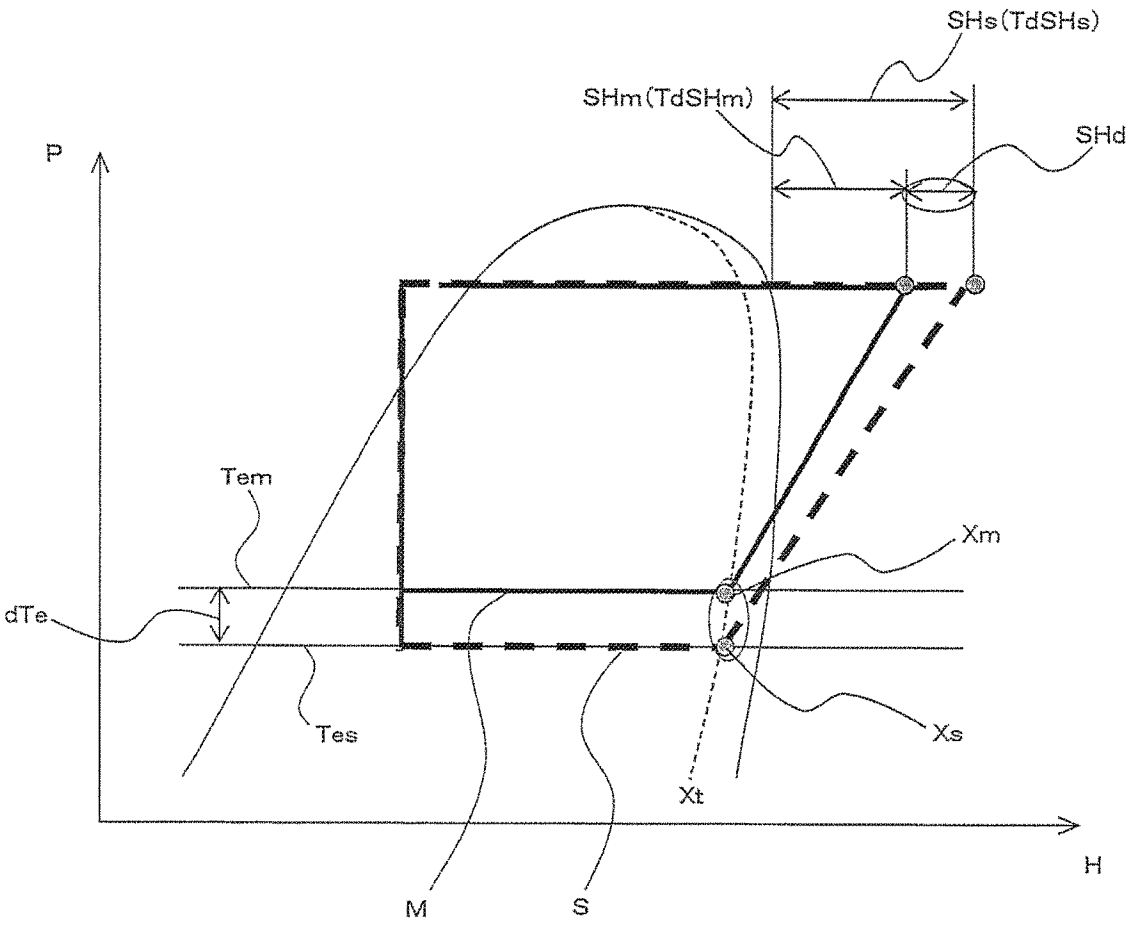
FIG. 3 is a P-H diagram (diagram for showing a relationship between a refrigerant pressure and a specific enthalpy) for showing the principle of liquid equalization control in the air-conditioning apparatus according to the embodiment of the present invention.

FIG. 3 is a P-H diagram (diagram for showing a relationship between a refrigerant pressure P and a specific enthalpy H) for showing the principle of liquid equalization control in the air-conditioning apparatus according to the embodiment of the present invention.

In the following, for convenience of description, the heat source unit 110*a* is referred to as "main unit" (corresponding to a lower heat source unit of the present invention), and the heat source unit 110*b* is referred to as "sub-unit" (corresponding to an upper heat source unit of the present invention). Then, taking a case where the main unit is installed below the sub-unit and the sub-unit is installed above the main unit as an example, concept and target of the liquid equalization control according to this embodiment are described. In FIG. 3, the solid line denoted by "M" represents a refrigeration cycle of the main unit (heat source unit 110*a*), whereas the broken line denoted by "S" represents a refrigeration cycle of the sub-unit (heat source unit 110*b*). Further, in this embodiment, a technology of controlling the amount of return liquid for each of the main unit and the sub-unit is referred to as "liquid equalization control" for convenience.

On P-H diagrams for both the main unit and the sub-unit, a difference is generated in low pressure (evaporating temperature Te) for suction due to a liquid head (pressure loss) in the low-pressure pipe (low-pressure main pipe 4 and other pipes), which is generated by "arranging the main unit on a lower side and the sub-unit on an upper side". When suction-side states are different, a difference is also generated in discharge-side state (in particular, in enthalpy). Those differences vary depending on a difference in pipe length between the main unit and the sub-unit and a position of the low-pressure distributor 5 in addition to a difference in height of the main unit and the sub-unit. In this embodiment, "length of low-pressure main pipe 4*a* of main unit<low-pressure main pipe 4*b* of sub-unit" is satisfied. Therefore, the above-mentioned differences increase as compared with a case of "length of low-pressure main pipe 4*a* of main unit=low-pressure main pipe 4*b* of sub-unit".

In this case, when the suction state of the compressor of the main unit and that of the compressor of the sub-unit (a value of a suction quality Xm of the compressor 111*a* of the main unit and a value of a suction quality Xs of the compressor 111*b* of the sub-unit) are the same as shown in FIG. 3, the amounts of liquid returned to the accumulators 115 of the main unit and the sub-unit are the same. In FIG. 3, the suction quality Xm of the compressor 111*a* of the main unit and the suction quality Xs of the compressor 111*b* of the sub-unit are a quality Xt. When the state shown in FIG. 3 is maintained, the amounts of refrigerant returned to the main unit and the sub-unit become equal to each other. As a result, imbalance in liquid (uneven distribution of liquid refrigerant) between the main unit and the sub-unit does not occur.

As described above, an evaporating temperature difference dTe is generated between the main unit and the sub-unit due to a difference in installation height or the like. Further, as shown in FIG. 3, under a state in which the amounts of returned liquid to the main unit and the sub-unit are equal to each other, a difference SHd is generated between a degree of discharge superheat SHm of the main unit and a degree of discharge superheat SHs of the sub-unit. Specifically, a proportional relationship is established between the difference SHd in degree of discharge superheat and the evaporating temperature difference dTe. Therefore, the amount of imbalance in liquid between the main unit and the sub-unit only needs to be controlled by controlling at least one of the expansion device for bypass 125*a* of the main unit or the expansion device for bypass 125*b* of the sub-unit so as to achieve the degree of discharge superheat SHs of the sub-unit=the degree of discharge superheat SHm of the main unit+dTe×α−d". In other words, the amount of imbalance in liquid between the main unit and the sub-unit only needs to be controlled by controlling at least one of the expansion device for bypass 125*a* of the main unit or the expansion device for bypass 125*b* of the sub-unit so as to achieve "a target degree of discharge superheat TdSHs of the sub-unit=a target degree of discharge superheat TdSHm of the main unit+dTe×α−d".

Here, α is a correction value, and d is a dead band for control. When those correction values are not required, α=1 and d=0 are set. When the correction values are required, the values only need to be changed in accordance with characteristics of the air-conditioning apparatus 100.

[Liquid Equalization Control Processing in Controller 400]

A description is now given for a flowchart of specific control and operation of the above-mentioned contents.

Figure 4:
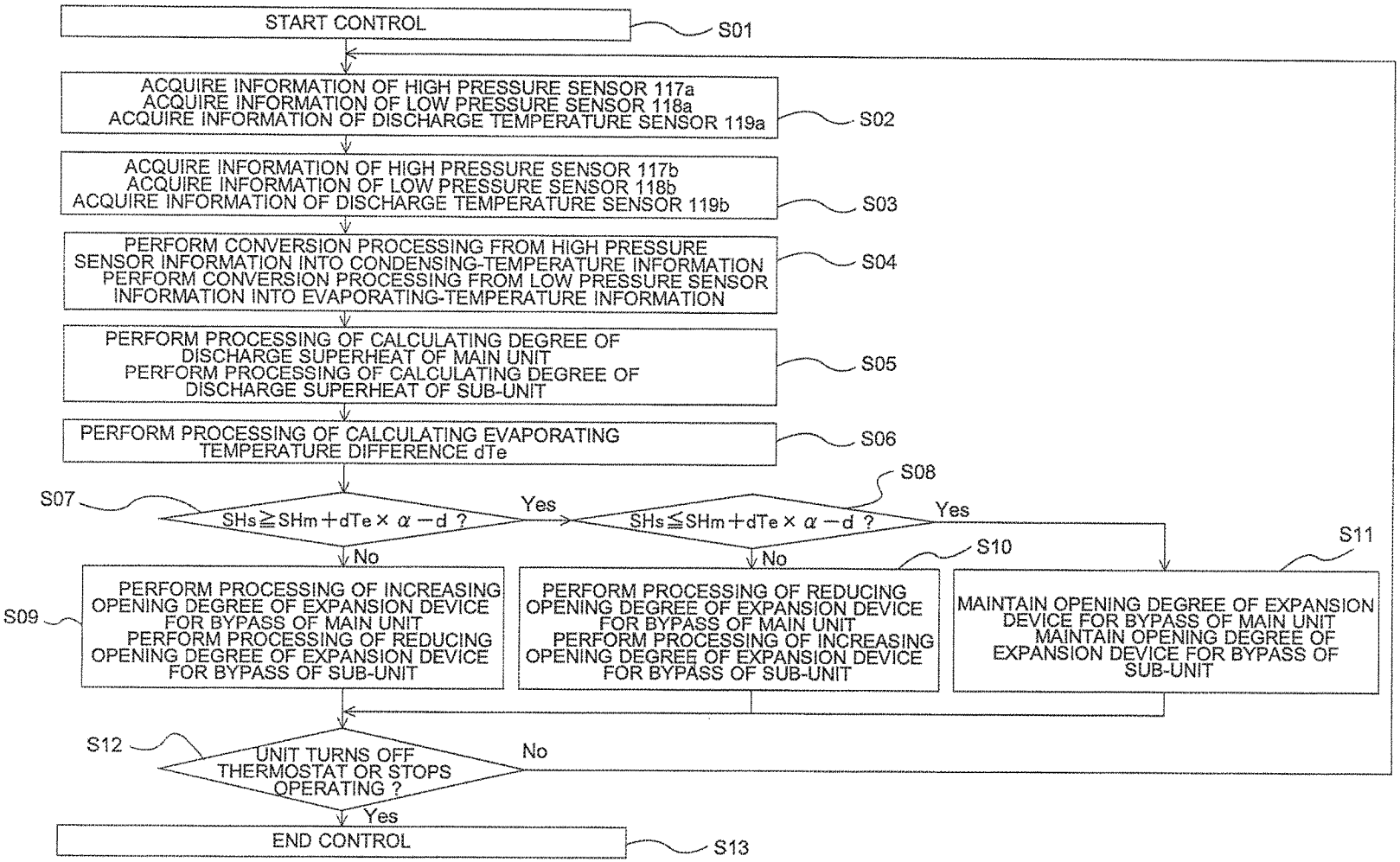
FIG. 4 is a flowchart for illustrating the liquid equalization control performed by a controller of the air-conditioning apparatus according to the embodiment of the present invention.

FIG. 4 is a flowchart for illustrating the liquid equalization control performed by the controller of the air-conditioning apparatus according to the embodiment of the present invention.

After starting control in Step S01, in Step S02, the controller 400 acquires information of the high pressure sensor 117*a*, information of the low pressure sensor 118*a*, and information of the discharge temperature sensor 119*a* in the heat source unit 110*a*. Thereafter, in Step S03, the controller 400 acquires information of the high pressure sensor 117*b*, information of the low pressure sensor 118*b*, and information of the discharge temperature sensor 119*b* in the heat source unit 110*b*. Although an example where the processing in Step S03 is executed after Step S02 is described in this case, the processing may be performed in a reverse order or may be performed in parallel.

Next, the controller 400 performs conversion processing on the pressure-sensor information acquired in Step S02 and Step S03 into condensing-temperature information and evaporating-temperature information. Specifically, the arithmetic processing circuit 413 of the controller 400 calculates the condensing temperature from a detection value of the high pressure sensor 117 and the evaporating temperature from a detection value of the low pressure sensor 118. Specifically, in this embodiment, the controller 400 and the high pressure sensor 117 correspond to a condensing-temperature detecting unit of the present invention, and the controller 400 and the low pressure sensor 118 correspond to an evaporating-temperature detecting unit of the present invention.

After Step 04, the information of the condensing temperature calculated in Step S04 and the discharge-temperature information acquired in Step S02 and Step S03 are converted into information of the degree of discharge superheat through processing in Step S05. Specifically, the arithmetic processing circuit 413 of the controller 400 performs a calculation by an expression "degree of discharge superheat=discharge temperature-condensing temperature". This calculation processing only needs to be performed in each of the main unit and the sub-unit. Specifically, in this embodiment, the discharge temperature sensor 119 corresponds to a discharged refrigerant temperature detecting unit (unit configured to detect a temperature of the refrigerant discharged from the compressor 111) of the present invention.

Further, in Step S06, the evaporating temperature difference dTe is calculated based on the evaporating-temperature information of the main unit and the sub-unit, which is calculated in Step S04. As a calculation expression, the evaporating-temperature difference is calculated by dTe=|evaporating temperature Tem of main unit-evaporating temperature Tes of sub-unit|. This processing is performed by, for example, at least one of the arithmetic processing circuit 413*a* of the main unit or the arithmetic processing circuit 413*b* of the sub-unit.

Although dTe is calculated so as to be able to flexibly deal with the pipe length or the difference in height, a fixed value may be used in consideration of stability of the refrigerant control (in this case, it is preferred that a restriction in the pipe length or the difference in height be imposed). Further, although an example where the processing in Step S06 is performed after Step S05 is described in this case, the processing may be performed in a reverse order or in parallel.

Step S07 to Step S11 are steps for illustrating a control configuration of the expansion device for bypass 125*a* of the main unit and the expansion device for bypass 125*b* of the sub-unit, which is performed by the controller 400 so as to achieve "the degree of discharge superheat SHs of the sub-unit=the degree of discharge superheat SHm of the main unit+dTe×α−d".

More specifically, in Step S07, the controller 400 (for example, at least one of the arithmetic processing circuit 413*a* of the main unit or the arithmetic processing circuit 413*b* of the sub-unit) compares "the degree of discharge superheat SHs of the sub-unit" and "the degree of discharge superheat SHm of the main unit+dTe×α−d". When "the degree of discharge superheat SHs of the sub-unit≥the degree of discharge superheat SHm of the main unit+dTe×α−d" is not satisfied, specifically, "the degree of discharge superheat SHs of the sub-unit<the degree of discharge superheat SHm of the main unit+dTe×α−d" is satisfied in Step S07, the controller 400 determines that a larger amount of liquid is returned to the sub-unit in terms of the refrigeration cycle, and therefore, in Step S09, increases the opening degree of the expansion device for bypass 125*a* of the main unit and reduces the opening degree of the expansion device for bypass 125*b* of the sub-unit. In this manner, the amount of liquid refrigerant flowing into the accumulator 115*a* of the main unit is increased relatively to the amount of liquid refrigerant flowing into the accumulator 115*b* of the sub-unit, thereby enabling correction of the imbalance in liquid between the main unit and the sub-unit.

The opening degree of the expansion device for bypass 125*a* of the main unit only needs to be increased relatively to the opening degree of the expansion device for bypass 125*b* of the sub-unit. Therefore, the opening degree of the expansion device for bypass 125*a* of the main unit only needs to be increased or the opening degree of the expansion device for bypass 125*b* of the sub-unit only needs to be reduced.

On the other hand, when the degree of discharge superheat SHs of the sub-unit≥the degree of discharge superheat SHm of the main unit+dTe×α−d" is satisfied in Step S07 and the degree of discharge superheat SHs of the sub-unit≥the degree of discharge superheat SHm of the main unit+dTe×α−d" is not satisfied in Step S08, the controller 400 proceeds to Step S10. Specifically, when the degree of discharge superheat SHs of the sub-unit>the degree of discharge superheat SHm of the main unit+dTe×α−d" is satisfied, the controller 400 determines that a larger amount of liquid is returned to the main unit in terms of the refrigeration cycle, and therefore reduces the opening degree of the expansion device for bypass 125*a* of the main unit and increases the opening degree of the expansion device for bypass 125*b* of the sub-unit in Step S10. In this manner, the amount of liquid refrigerant flowing into the accumulator 115*a* of the sub-unit is increased relatively to the amount of liquid refrigerant flowing into the accumulator 115*a* of the main unit, thereby enabling correction of the imbalance in liquid between the main unit and the sub-unit.

The opening degree of the expansion device for bypass 125*b* of the sub-unit only needs to be increased relatively to the opening degree of the expansion device for bypass 125*a* of the main unit. Therefore, the opening degree of the expansion device for bypass 125*b* of the sub-unit only needs to be increased or the opening degree of the expansion device for bypass 125*a* of the main unit only needs to be reduced.

Further, when "the degree of discharge superheat SHs of the sub-unit≥the degree of discharge superheat SHm of the main unit+dTe×α−d" is satisfied in Step S07 and "the degree of discharge superheat SHs of the sub-unit≤the degree of discharge superheat SHm of the main unit+dTe×α−d" is satisfied in Step S08, the controller 400 proceeds to Step S11. Specifically, when "the degree of discharge superheat SHs of the sub-unit=the degree of discharge superheat SHm of the main unit+dTe×α−d" is satisfied, the controller 400 determines that the imbalance in liquid (uneven distribution of the liquid refrigerant) between the main unit and the sub-unit does not occur, and therefore maintains the opening degree of the expansion device for bypass 125*a* of the main unit and the opening degree of the expansion device for bypass 125*b* of the sub-unit in Step S11.

The above-mentioned operation is a flow of a series of control operations. Unless the unit stops operating or turns OFF the thermostat in Step S12, the operation from Step S02 to Step S11 is repeated. By the above-mentioned control, the suction states of the compressors 111 of the main unit and the sub-unit are constantly maintained. Therefore, even when the heat source units 110 are installed vertically, the imbalance in refrigerant can be prevented.

Now, refrigerant usable for the air-conditioning apparatus 100 is described. The refrigerant usable for the refrigerant cycle of the air-conditioning apparatus 100 includes a zeotropic refrigerant mixture, a near-azeotropic refrigerant mixture, and single refrigerant. The zeotropic refrigerant mixture includes R407C (R32/R125/R134a) being HFC (hydrofluorocarbon) refrigerant. The zeotropic refrigerant mixture is a mixture of refrigerants having different boiling points, and hence has a characteristic in that liquid-phase refrigerant and gas-phase refrigerant have different composition ratios. The near-azeotropic refrigerant mixture includes R410A (R32/R125) and R404A (R125/R143a/R134a) being the HFC refrigerant. The near-azeotropic refrigerant mixture has a characteristic in an operating pressure about 1.6 times larger than R22 in addition to the same characteristics as the zeotropic refrigerant mixture.

The single refrigerant includes R22 being HCFC (hydrochlorofluorocarbon) refrigerant and R134a being the HFC refrigerant. The single refrigerant is not a mixture, and therefore has a characteristic in easy handling. Besides, carbon dioxide, propane, isobutene, and ammonia, which are natural refrigerant, can also be used. R22 is chlorodifluoromethane, R32 is difluoromethane, R125 is pentafluoromethane, R134a is 1,1,1,2-tetrafluoromethane, and R143a is 1,1,1-trifluoromethane. The refrigerant only needs to be used in accordance with use and purpose of the air-conditioning apparatus 100.

As described above, in the air-conditioning apparatus 100 according to this embodiment, the expansion device for bypass 125*a* and the heat source unit 110*b* of the heat source unit 110*a* and the heat source unit 110*b* that are vertically installed are controlled so that a value of the suction quality Xm of the compressor 111*a* of the main unit and a value of the suction quality Xs of the compressor 111*b* of the sub-unit become the same. Therefore, the air-conditioning apparatus 100 according to this embodiment can suppress the imbalance in the amount of refrigerant between the heat source unit 110*a* and the heat source unit 110*b* so as to enable the vertical mounting of the heat source unit 110*a* and the heat source unit 110*b*. Hence, the air-conditioning apparatus 100 according to this embodiment also contributes to installation space saving.

Figure 5:
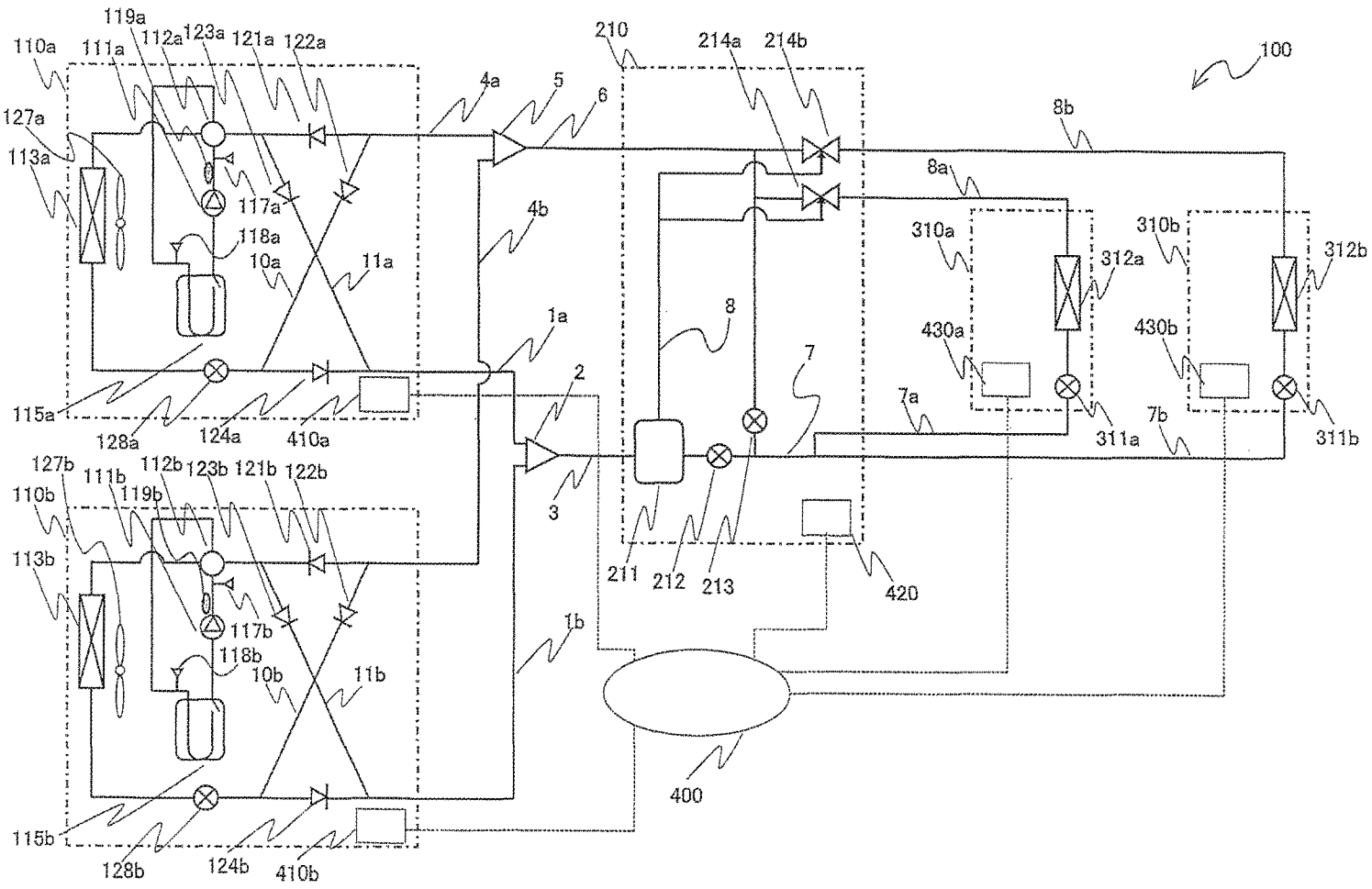
FIG. 5 is a circuit diagram for schematically illustrating a refrigerant circuit configuration of a further example of the air-conditioning apparatus according to the embodiment of the present invention.

In this embodiment, a flow control device (device configured to regulate a flow rate of the refrigerant flowing through the outdoor heat exchanger 113) to be used for the liquid equalization control is constructed of the bypass 126 and the expansion device for bypass 125. However, the flow control device is not limited thereto. As illustrated in FIG. 5, when the outdoor heat exchanger 113 functions as an evaporator, an expansion device for flow regulation 128 may be provided to a pipe on the refrigerant inflow side of the outdoor heat exchanger 113 so that the expansion device for flow regulation 128 may be used as the flow control device. More specifically, when "SHs<SHm+dTe×α−d" is satisfied (in Step S09 of FIG. 4), the controller 400 only needs to increase an opening degree of an expansion device for flow regulation 128*a* of the main unit relatively to an opening degree of an expansion device for flow regulation 128*b* of the sub-unit. In this manner, the amount of refrigerant flowing through the outdoor heat exchanger 113*a* of the main unit can be increased. Specifically, the amount of liquid refrigerant flowing into the accumulator 115*a* of the main unit can be increased relatively to the amount of liquid refrigerant flowing into the accumulator 115*b* of the sub-unit. As a result, the imbalance in liquid between the main unit and the sub-unit can be corrected. Further, when "SHs>SHm+dTe×α−d" is satisfied (in Step S10 of FIG. 4), the controller 400 only needs to increase the opening degree of the expansion device for flow regulation 128*b* of the sub-unit relatively to the opening degree of the expansion device for flow regulation 128*a* of the main unit. In this manner, the amount of refrigerant flowing through the outdoor heat exchanger 113*b* of the sub-unit can be increased. Specifically, the amount of liquid refrigerant flowing into the accumulator 115*b* of the sub-unit can be increased relatively to the amount of liquid refrigerant flowing into the accumulator 115*a* of the main unit. As a result, the imbalance in liquid between the main unit and the sub-unit can be corrected.

Further, although the liquid equalization control is performed by using the flow control device in this embodiment, the outdoor air-sending device 127 (heat-exchange target supply unit) may be used together with the flow control device or in place of the flow control device. Specifically, the controller 400 may control at least one of the amount of air from (rotation speed of) the outdoor air-sending device 127*a* of the main unit or the amount of air from (rotation speed of) the outdoor air-sending device 127*b* of the sub-unit so that the value of the suction quality Xm of the compressor 111*a* of the main unit and the value of the suction quality Xs of the compressor 111*b* of the sub-unit become the same. For example, when "SHs<SHm+dTe×α−d" is satisfied (in Step S09 of FIG. 4), the controller 400 only needs to reduce the amount of air from the outdoor air-sending device 127*a* of the main unit relatively to the amount of air from the outdoor air-sending device 127*b* of the sub-unit. In this manner, the amount of refrigerant evaporating in the outdoor heat exchanger 113*a* of the main unit can be reduced so that the amount of liquid refrigerant flowing into the accumulator 115*a* of the main unit can be increased relatively to the amount of liquid refrigerant flowing into the accumulator 115*b* of the sub-unit. Thus, the imbalance in liquid between the main unit and the sub-unit can be corrected. Further, when "SHs>SHm+dTe×α−d" is satisfied (in Step S10 of FIG. 4), the controller 400 only needs to reduce the amount of air from the outdoor air-sending device 127*b* of the sub-unit relatively to the amount of air from the outdoor air-sending device 127*a* of the main unit. In this manner, the amount of refrigerant evaporating in the outdoor heat exchanger 113*b* of the sub-unit can be reduced so that the amount of liquid refrigerant flowing into the accumulator 115*b* of the sub-unit can be increased relatively to the amount of liquid refrigerant flowing into the accumulator 115*a* of the main unit. Thus, the imbalance in liquid between the main unit and the sub-unit can be corrected. When the heat exchange target for the refrigerant flowing through the outdoor heat exchanger 113 is liquid, e.g., water or brine, a flow rate (amount of supply of water, brine, or other liquid to the outdoor heat exchanger 113) of a pump (heat exchange target supply unit) configured to supply water, brine, or other liquid to the outdoor heat exchanger 113 only needs to be controlled in the same manner as that for the amounts of air from the outdoor heat exchangers 113.

Although the evaporating-temperature detecting unit is constructed of the controller 400 and the low pressure sensor 1187 in this embodiment, a temperature sensor configured to detect the temperature of the refrigerant flowing through the outdoor heat exchanger 113 functioning as an evaporator may be provided as an evaporating-temperature detecting unit so that the temperature sensor directly detects the evaporating temperature. Further, although the condensing-temperature detecting unit is constructed of the controller 400 and the high pressure sensor 117 in this embodiment, a temperature sensor configured to detect the temperature of the refrigerant flowing through the outdoor heat exchanger 312 functioning as a condenser may be provided as a condensing-temperature detecting unit so that the temperature sensor directly detects the condensing temperature.

Further, the evaporating temperature difference dTe is used in this embodiment when the value of the suction quality Xm of the compressor 111*a* of the main unit and the value of the suction quality Xs of the compressor 111*b* of the sub-unit become the same. However, the control is not limited thereto. A temperature sensor configured to detect the temperature of the refrigerant to be sucked into the compressor 111 may be provided so as to calculate the suction quality of the compressor 111 from a detection value of the temperature sensor and the evaporating temperature, thereby performing the control so that the value of the suction quality Xm of the compressor 111*a* of the main unit and the value of the suction quality Xs of the compressor 111*b* of the sub-unit become the same.

Further, it is to be understood that the liquid equalization control according to the present invention can be adopted for an air-conditioning apparatus including the single indoor unit 310 without being limited to the air-conditioning apparatus 100 including the plurality of indoor units 310. In this case, the branch unit 210 is not required to be provided. Further, although the air-conditioning apparatus 100 according to this embodiment includes the two heat source units 110, it is to be understood that three or more heat source units 110 may be provided. Through the liquid equalization control of the present invention for the two heat source units 110 that are installed vertically, the above-mentioned effects can be obtained. Further, although the air-conditioning apparatus 100 capable of executing both the cooling and the heating in the indoor units 310 is described as an example in this embodiment, the present invention can be carried out as long as an air-conditioning apparatus includes the indoor unit 310 capable of performing at least the heating operation, specifically, as long as an air-conditioning apparatus includes the outdoor heat exchanger functioning as an evaporator.

REFERENCE SIGNS LIST

1 high-pressure main pipe 2 high-pressure distributor 3 high-pressure main pipe 4 low-pressure main pipe 5 low-pressure distributor
6 low-pressure main pipe 7 liquid refrigerant pipe 7*a*, 7*b* liquid branch pipe 8 gas refrigerant pipe 8*a*, 8*b* gas branch pipe 10 first connecting pipe 11 second connecting pipe 100 air-conditioning apparatus 110 heat source unit 111 compressor 112 flow switching valve 113 outdoor heat exchanger 115 accumulator 117 high pressure sensor 118 low pressure sensor 119 discharge temperature sensor 121-124 check valve 125 expansion device for bypass 126 bypass 127 outdoor air-sending device
128 expansion device for flow regulation 210 branch unit 211 gas-liquid separator 212 expansion device 213 expansion device 214 flow switching valve 310 indoor unit 311 indoor-side expansion device 312 indoor-side heat exchanger 400 controller 410 heat source-unit control unit
411 heat source unit capacity information output unit 412 pressure sensor and temperature sensor information storing unit 413 arithmetic processing circuit 414 actuator control signal output unit 420 branch-unit control unit
421 arithmetic processing circuit 422 operation allowance unit determining unit 430 indoor-unit control unit 431 arithmetic processing circuit

The invention claimed is:

1. An air-conditioning apparatus, comprising:
at least one indoor unit including
an indoor heat exchanger, and
an indoor-side expansion device;
a plurality of heat source units connected in parallel to the at least one indoor unit, each of the plurality of heat source units including
a compressor,
an outdoor heat exchanger configured to function at least as an evaporator,
an accumulator connected to a suction side of the compressor, and
at least one of an outdoor air-sending device, including a fan, configured to supply a heat exchange target for refrigerant to the outdoor heat exchanger and a flow control device, including a bypass and an expansion device for bypass, including an electronic expansion valve, configured to regulate a flow rate of the refrigerant flowing through the outdoor heat exchanger; and
a controller configured to control at least one of the outdoor air-sending device and the flow control device,
wherein two of the plurality of heat source units include one unit corresponding to an upper heat source unit installed on an upper side and an other unit corresponding to a lower heat source unit installed below the upper heat source unit, and
wherein the controller is configured to, under a state in which the outdoor heat exchanger functions as an evaporator, control at least one of the outdoor air-sending device and the flow control device so that a suction quality of the compressor of the upper heat source unit and a suction quality of the compressor of the lower heat source unit come to have a same value.

2. The air-conditioning apparatus of claim 1, wherein each of the upper heat source unit and the lower heat source unit includes a discharge temperature sensor configured to detect a temperature of the refrigerant discharged from the compressor, a condensing-temperature detecting unit, including the controller and a high pressure sensor, configured to directly or indirectly detect a condensing temperature of the refrigerant discharged from the compressor, and an evaporating-temperature detecting unit, including the controller and a low pressure sensor, configured to directly or indirectly detect an evaporating temperature of the refrigerant flowing through the outdoor heat exchanger functioning as an evaporator, and wherein the controller is configured to calculate a degree of discharge superheat of the compressor, which is obtained by subtracting a detection value of the condensing-temperature detecting unit from a detection value of the discharged refrigerant temperature detecting unit, for each of the upper heat source unit and the lower heat source unit, calculate an evaporating temperature difference dTe, which is obtained by subtracting an evaporating temperature of the refrigerant flowing through the outdoor heat exchanger of the upper heat source unit from an evaporating temperature of the refrigerant flowing through the outdoor heat exchanger of the lower heat source unit, and control, when the degree of discharge superheat of the compressor of the upper heat source unit is defined as SHs, the degree of discharge superheat of the compressor of the lower heat source unit is defined as SHm, a correction value is defined as a, and a dead band for control is defined as d, at least one of the heat exchange target supply unit and the flow control device so as to achieve $SHs=SHm+dTe\times\alpha-d$.

3. The air-conditioning apparatus of claim 2, wherein the bypass is connected to a refrigerant inflow side and a refrigerant outflow side of the outdoor heat exchanger, the bypass being configured to bypass the outdoor heat exchanger; and the expansion device for bypass is provided to the bypass, and the expansion device is configured to regulate a flow rate of the refrigerant flowing through the bypass, and wherein the controller is configured to increase an opening degree of the expansion device for bypass of the lower heat source unit with respect to an opening degree of the expansion device for bypass of the upper heat source unit when $SHs<SHm+dTe\times\alpha-d$ is satisfied, and increase the opening degree of the expansion device for bypass of the upper heat source unit with respect to the opening degree of the expansion device for bypass of the lower heat source unit when $SHs>SHm+dTe\times\alpha-d$ is satisfied.

4. The air-conditioning apparatus of claim 2, wherein the flow control device of each of the upper heat source unit and the lower heat source unit includes an expansion device for flow regulation provided to a pipe on a refrigerant inflow side of the outdoor heat exchanger when the outdoor heat exchanger functions as an evaporator, and wherein the controller is configured to increase an opening degree of the expansion device for flow regulation of the lower heat source unit with respect to an opening degree of the expansion device for flow regulation of the upper heat source unit when $SHs<SHm+dTe\times\alpha-d$ is satisfied, and increase the opening degree of the expansion device for flow regulation of the upper heat source unit with respect to the opening degree of the expansion device for flow regulation of the lower heat source unit when $SHs>SHm+dTe\times\alpha-d$ is satisfied.

5. The air-conditioning apparatus of claim 2, wherein the controller is configured to reduce an amount of supply of the heat exchange target in the heat exchange target supply unit of the lower heat source unit with respect to an amount of supply of the heat exchange target in the heat exchange target supply unit of the upper heat source unit when $SHs<SHm+dTe\times\alpha-d$ is satisfied, and reduce the amount of supply of the heat exchange target in the heat exchange target supply unit of the upper heat source unit with respect to the amount of supply of the heat exchange target in the heat exchange target supply unit of the lower heat source unit when $SHs>SHm+dTe\times\alpha-d$ is satisfied.

6. The air-conditioning apparatus of claim 2, wherein the condensing-temperature detecting unit includes the high pressure sensor configured to detect a pressure of the refrigerant discharged from the compressor, and the controller configured to calculate the condensing temperature of the refrigerant discharged from the compressor from a detection value of the first pressure detecting unit.

7. The air-conditioning apparatus of claim 2, wherein the evaporating-temperature detecting unit includes the low pressure sensor configured to detect a pressure of the refrigerant flowing through the outdoor heat exchanger functioning as the evaporator, and the controller configured to calculate the evaporating temperature of the refrigerant flowing through the outdoor heat exchanger from a detection value of the second pressure detecting unit.

8. The air-conditioning apparatus of claim 1, wherein the at least one indoor unit comprises a plurality of the indoor units, and the air-conditioning apparatus further comprises a branch unit configured to connect the plurality of the indoor units in parallel to each of the plurality of heat source units.

* * * * *